US009067101B1

(12) United States Patent
Chuang

(10) Patent No.: US 9,067,101 B1
(45) Date of Patent: Jun. 30, 2015

(54) OBLONG ORBITAL EXERCISING MACHINE

(71) Applicant: Yen-Chi Chuang, Taichung (TW)

(72) Inventor: Yen-Chi Chuang, Taichung (TW)

(73) Assignee: High Spot Health Technology Co., Ltd., Taichung (TW)

( * ) Notice: Subject to any disclaimer, the term of this patent is extended or adjusted under 35 U.S.C. 154(b) by 60 days.

(21) Appl. No.: 14/146,047

(22) Filed: Jan. 2, 2014

(51) Int. Cl.
*A63B 22/04* (2006.01)
*A63B 22/06* (2006.01)
*A63B 22/20* (2006.01)

(52) U.S. Cl.
CPC ..... *A63B 22/0664* (2013.01); *A63B 2022/067* (2013.01); *A63B 2022/0676* (2013.01); *A63B 22/201* (2013.01)

(58) Field of Classification Search
CPC .. A63B 22/0664; A63B 22/20; A63B 22/201; A63B 22/203; A63B 2022/067; A63B 2022/0676; A63B 2225/09
USPC ..... 482/51–53, 57, 70, 71, 79, 80
See application file for complete search history.

(56) References Cited

U.S. PATENT DOCUMENTS

| | | | | |
|---|---|---|---|---|
| 7,223,209 | B2 * | 5/2007 | Lee | 482/52 |
| 7,316,633 | B2 * | 1/2008 | Liao et al. | 482/52 |
| 7,654,936 | B2 * | 2/2010 | Liao et al. | 482/52 |
| 8,936,535 | B1 * | 1/2015 | Chen | 482/52 |
| 2007/0042871 | A1 * | 2/2007 | Wu et al. | 482/52 |
| 2008/0167165 | A1 * | 7/2008 | Liao et al. | 482/52 |
| 2008/0227602 | A1 * | 9/2008 | Stearns et al. | 482/52 |
| 2008/0318736 | A1 * | 12/2008 | Smith | 482/52 |
| 2015/0080188 | A1 * | 3/2015 | Chuang | 482/52 |

FOREIGN PATENT DOCUMENTS

| | | |
|---|---|---|
| TW | 131760 | 7/1997 |
| TW | M407086 U | 7/2011 |

* cited by examiner

*Primary Examiner* — Stephen Crow
*Assistant Examiner* — Gregory Winter
(74) *Attorney, Agent, or Firm* — Alan D. Kamrath; Kamrath IP Lawfirm, P.A.

(57) ABSTRACT

An oblong orbital exercising machine includes a main frame, an upright mounted on the main frame, a base frame mounted on the main frame, a support plate mounted on the base frame, two swinging members pivotally connected with the base frame, two primary rollers each connected with the respective swinging member and each placed on the support plate, a cycle movement mechanism mounted on the main frame, a belt wheel mounted on the upright, a belt mounted between the belt wheel and the cycle movement mechanism, two cranks mounted on the belt wheel, two driving levers each pivotally connected with the respective crank and the respective primary roller, two pedals each pivotally connected with the respective driving lever, two handles each mounted on the upright, and two driven levers each pivotally connected with the respective handle and the respective pedal.

5 Claims, 16 Drawing Sheets

OBLONG ORBITAL EXERCISING MACHINE

BACKGROUND OF THE INVENTION

1. Field of the Invention

The present invention relates to an exercising machine and, more particularly, to an exercising machine with an oblong orbit or cycle.

2. Description of the Related Art

A conventional oblong orbital exercising machine comprises a main frame, an upright post mounted on the front portion of the main frame, two handles each having an upper end pivotally connected with the upright post, a cycle movement mechanism mounted on the rear portion of the main frame, two pivot members mounted on two opposite sides of the cycle movement mechanism, two links each having a first end pivotally connected with the lower end of a respective one of the handles and a second end pivotally connected with a respective one of the pivot members, and two pedals each mounted on a respective one of the links. In operation, when a user operates the exercising machine, his hands can hold the handles to move the handles and his feet tread the pedals to move the links. In such a manner, the links are driven by rotation of the cycle movement mechanism and by pivotal motion of the handles so as to perform an oblong orbit movement so that the user can exercise his hands and legs.

A prior art reference was disclosed in the Taiwanese Patent No. 131760, in which the user's two feet are moved forward and backward to perform an oblong orbit movement. Another prior art reference was disclosed in the Taiwanese Patent No. M407086, in which two arcuate sliding tracks are provided so that the user's two feet are moved forward and backward in a curved manner. However, each of the sliding tracks has an outward arcuate profile so that each of the sliding tracks needs a precise manufacturing process, thereby increasing the cost and time of fabrication.

BRIEF SUMMARY OF THE INVENTION

The primary objective of the present invention is to provide an oblong orbital exercising machine with a motion trace that performs full body torsion and swinging.

In accordance with the present invention, there is provided an oblong orbital exercising machine comprising a main frame, an upright mounted on a front portion of the main frame, a base frame mounted on a rear portion of the main frame and provided with two shafts, a support plate mounted on the base frame, two swinging members each having a first end pivotally connected with the respective shaft of the base frame, two primary rollers each connected with a second end of the respective swinging member and each placed on the support plate, a cycle movement mechanism mounted on the main frame, a belt wheel rotatably mounted on the upright, a belt mounted between the belt wheel and the cycle movement mechanism, two cranks mounted on two opposite sides of the belt wheel, two driving levers each having a first end pivotally connected with the respective crank and a second end pivotally connected with the respective primary roller, two pedals each pivotally connected with the second end of the respective driving lever, two handles each pivotally mounted on the upright, and two driven levers each having a first end pivotally connected with the respective handle and a second end pivotally connected with the respective pedal. Each of the swinging members is pivotable about the respective shaft of the base frame. Each of the primary rollers is slidable forward or backward on the support plate along an arcuate path.

According to the primary advantage of the present invention, the pedals are moved forward and backward in a curved manner to turn and swing the user's body, so as to achieve a full body turning and swinging function, thereby greatly enhancing the exercising effect.

According to another advantage of the present invention, the lifting device is operated to change the inclined angle of the base frame relative to the bottom frame, so as to satisfy the user's requirement.

According to a further advantage of the present invention, the support plate is made easily to replace a conventional sliding track that needs a precise manufacturing process, thereby decreasing the cost and time of fabrication.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
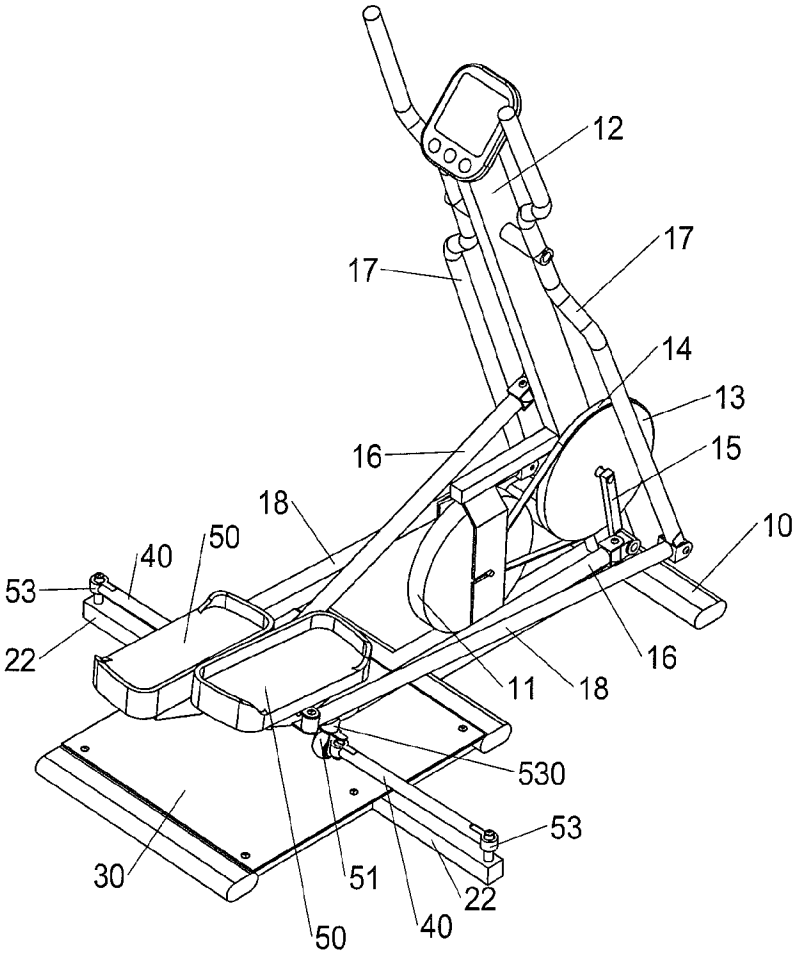
FIG. 1 is a perspective view of an oblong orbital exercising machine in accordance with the preferred embodiment of the present invention.
Figure 2:
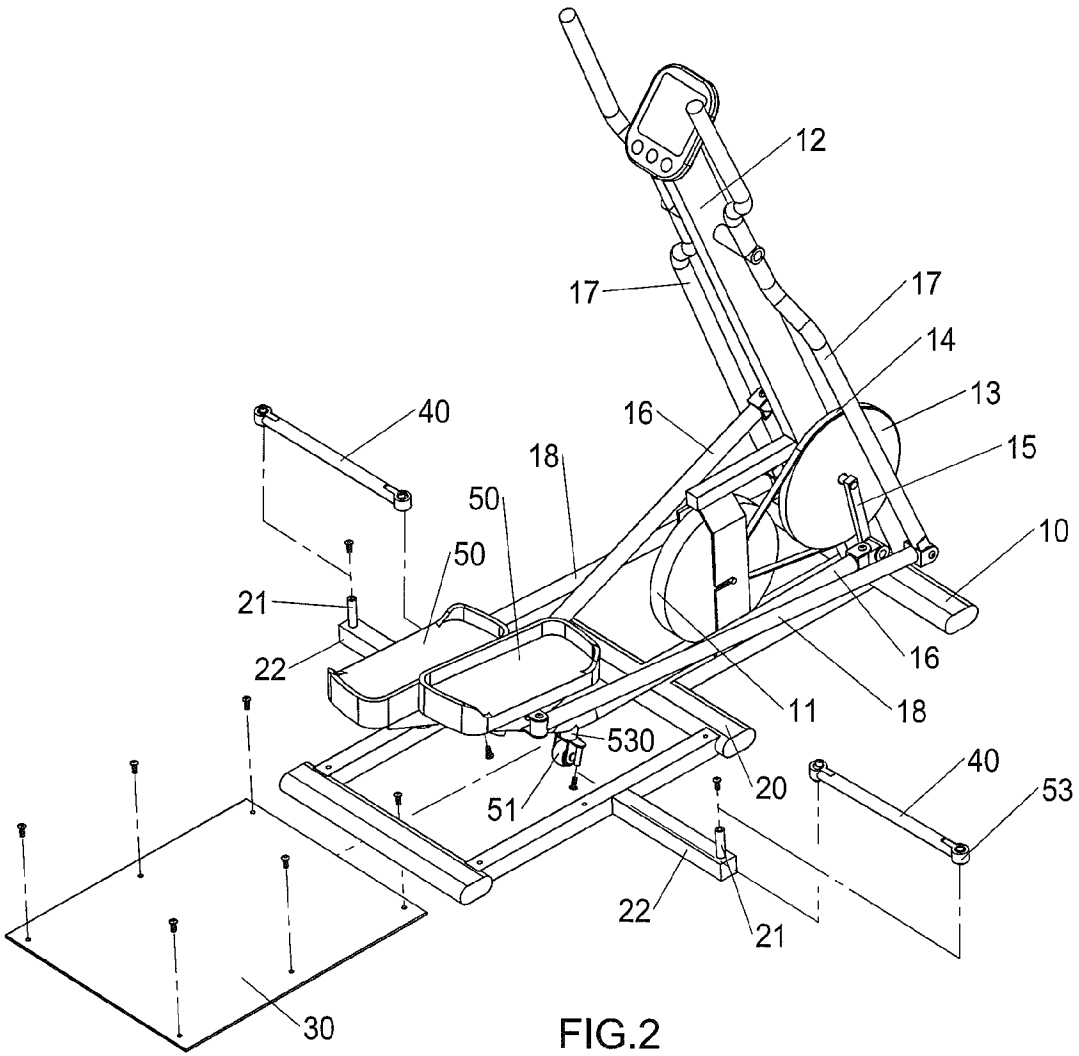
FIG. 2 is a partially exploded perspective view of the oblong orbital exercising machine as shown in FIG. 1.
Figure 3:
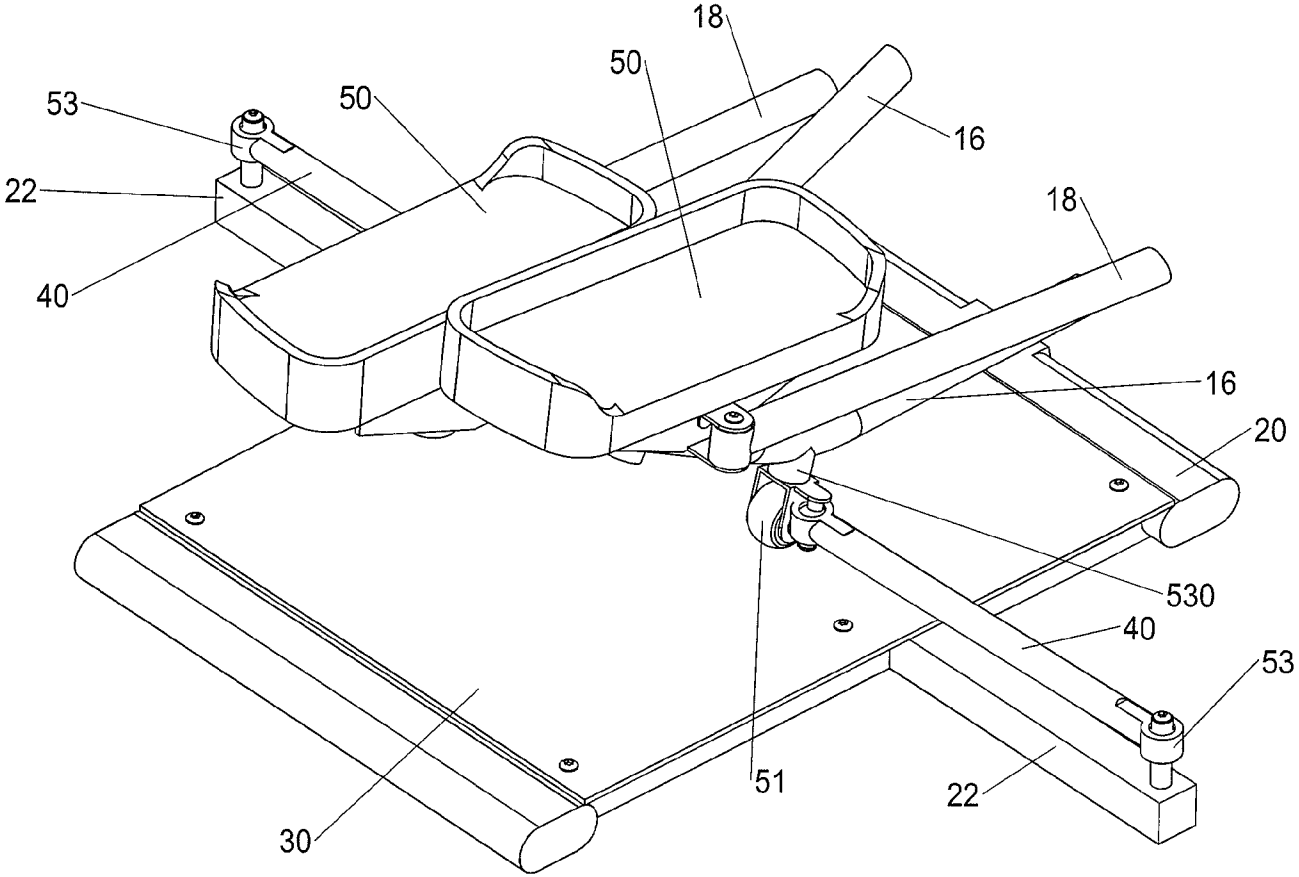
FIG. 3 is a partially perspective view of the oblong orbital exercising machine as shown in FIG. 1.
Figure 4:
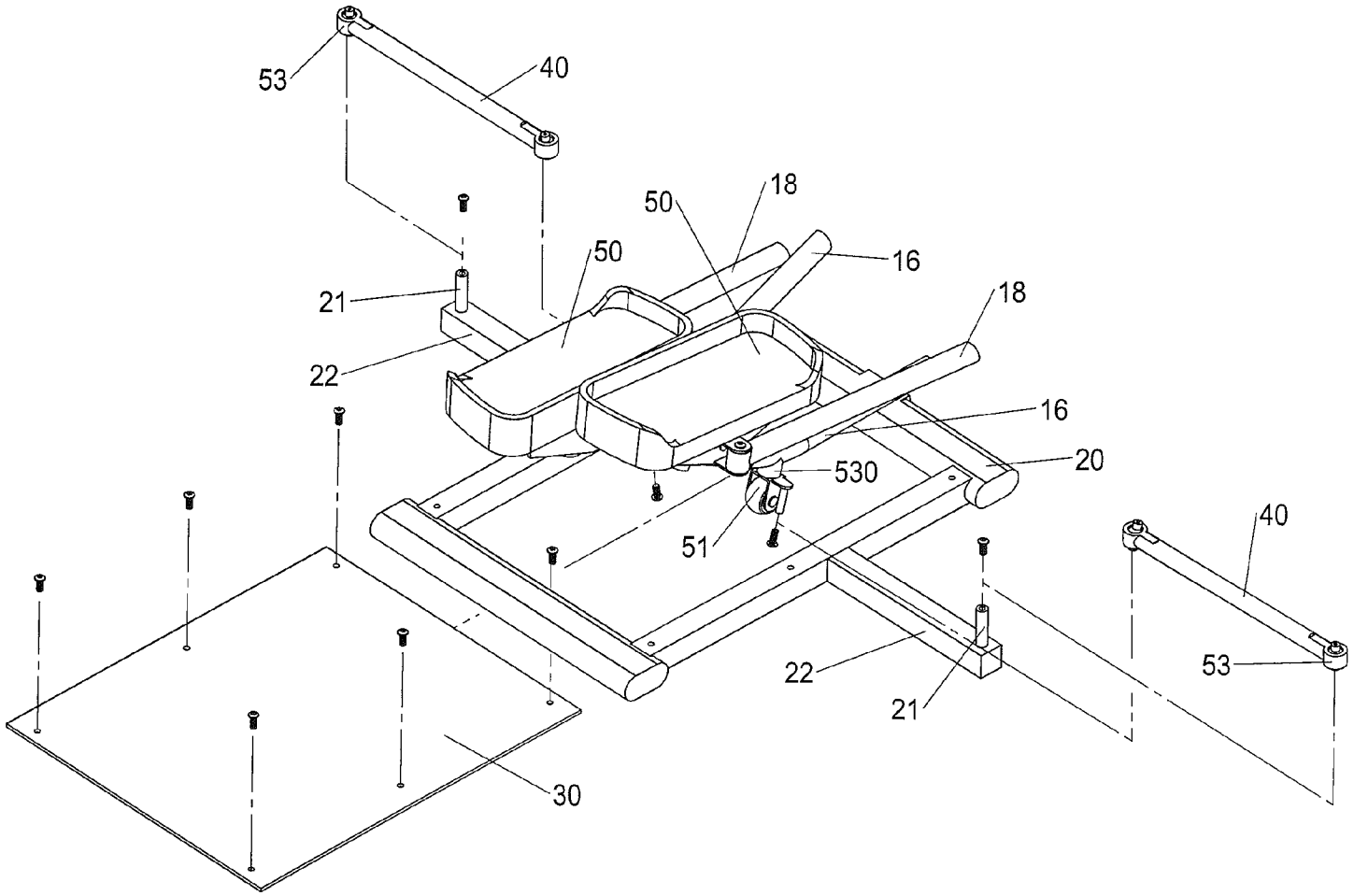
FIG. 4 is an exploded perspective view of the oblong orbital exercising machine as shown in FIG. 3.

Referring to the drawings and initially to FIGS. 1-8, an oblong orbital exercising machine in accordance with the preferred embodiment of the present invention comprises a main frame 10, an upright 12 mounted on a front portion of the main frame 10, a base frame 20 mounted on a rear portion of the main frame 10 and provided with two shafts 21, a support plate 30 mounted on the base frame 20, two swinging members 40 each having a first end pivotally connected with the respective shaft 21 of the base frame 20, two primary rollers 51 each connected with a second end of the respective swinging member 40 and each placed on the support plate 30, a cycle movement mechanism 11 mounted on the main frame 10, a belt wheel 13 rotatably mounted on the upright 12, a belt 14 mounted between the belt wheel 13 and the cycle movement mechanism 11, two cranks 15 mounted on two opposite sides of the belt wheel 13, two driving levers 16 each having a first end pivotally connected with the respective crank 15 and a second end pivotally connected with the respective primary roller 51, two pedals 50 each pivotally connected with the second end of the respective driving lever 16, two handles 17 each pivotally mounted on the upright 12, and two driven levers 18 each having a first end pivotally connected with the respective handle 17 and a second end pivotally connected with the respective pedal 50.

The cranks 15 are arranged in different angles. Each of the cranks 15 has a first end pivotally mounted the belt wheel 13 and a second end pivotally connected with the first end of the respective driving lever 16. Each of the swinging members 40 is pivotable about the respective shaft 21 of the base frame 20. The first end of each of the swinging members 40 is connected with the respective shaft 21 of the base frame 20 by a universal bearing 53. Each of the primary rollers 51 is slidable forward or backward on the support plate 30 along an arcuate path. Each of the primary rollers 51 is located under the respective driving lever 16 and is connected with the second end of the respective driving lever 16 by a universal bearing 530. The base frame 20 is provided with two opposite fixing members 22. Each of the fixing members 22 is extended outwardly and horizontally from the base frame 20. Each of the shafts 21 of the base frame 20 is mounted on and perpendicular to the respective fixing member 22. Each of the driving levers 16 has a substantially V-shaped profile. The second end of each of the driving levers 16 is provided with a pivot tube 161. Each of the pedals 50 has a bottom provided with a bottom board 52. The bottom board 52 of each of the pedals 50 is pivotally connected with a pivot member 56 which is pivotally connected with the pivot tube 161 of the respective driving lever 16.

Figure 5:
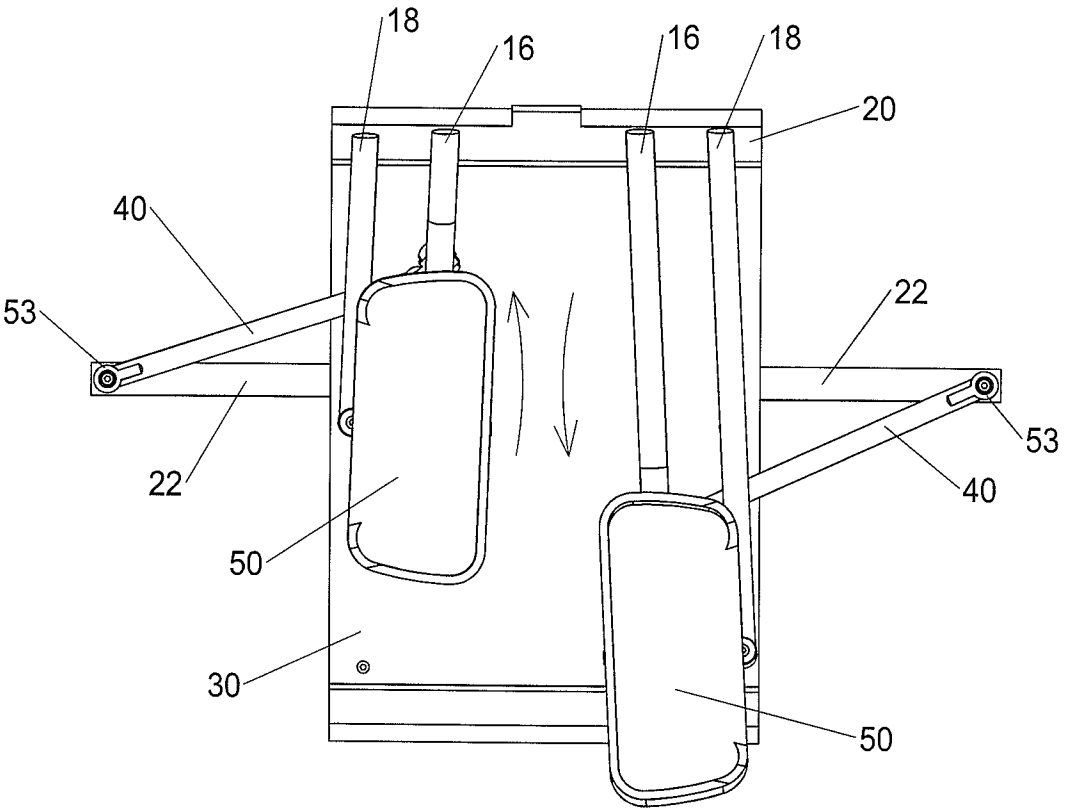
FIG. 5 is a top operational view of the oblong orbital exercising machine as shown in FIG. 3.
Figure 6:
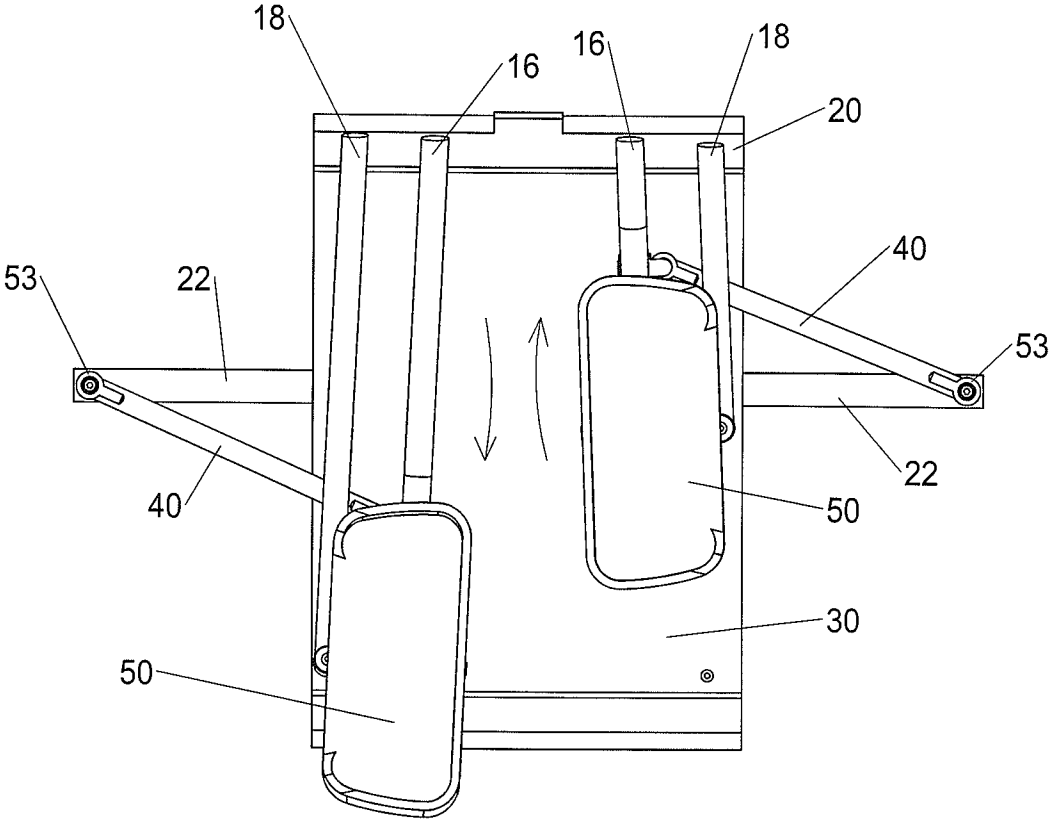
FIG. 6 is another top operational view of the oblong orbital exercising machine as shown in FIG. 3.
Figure 7:
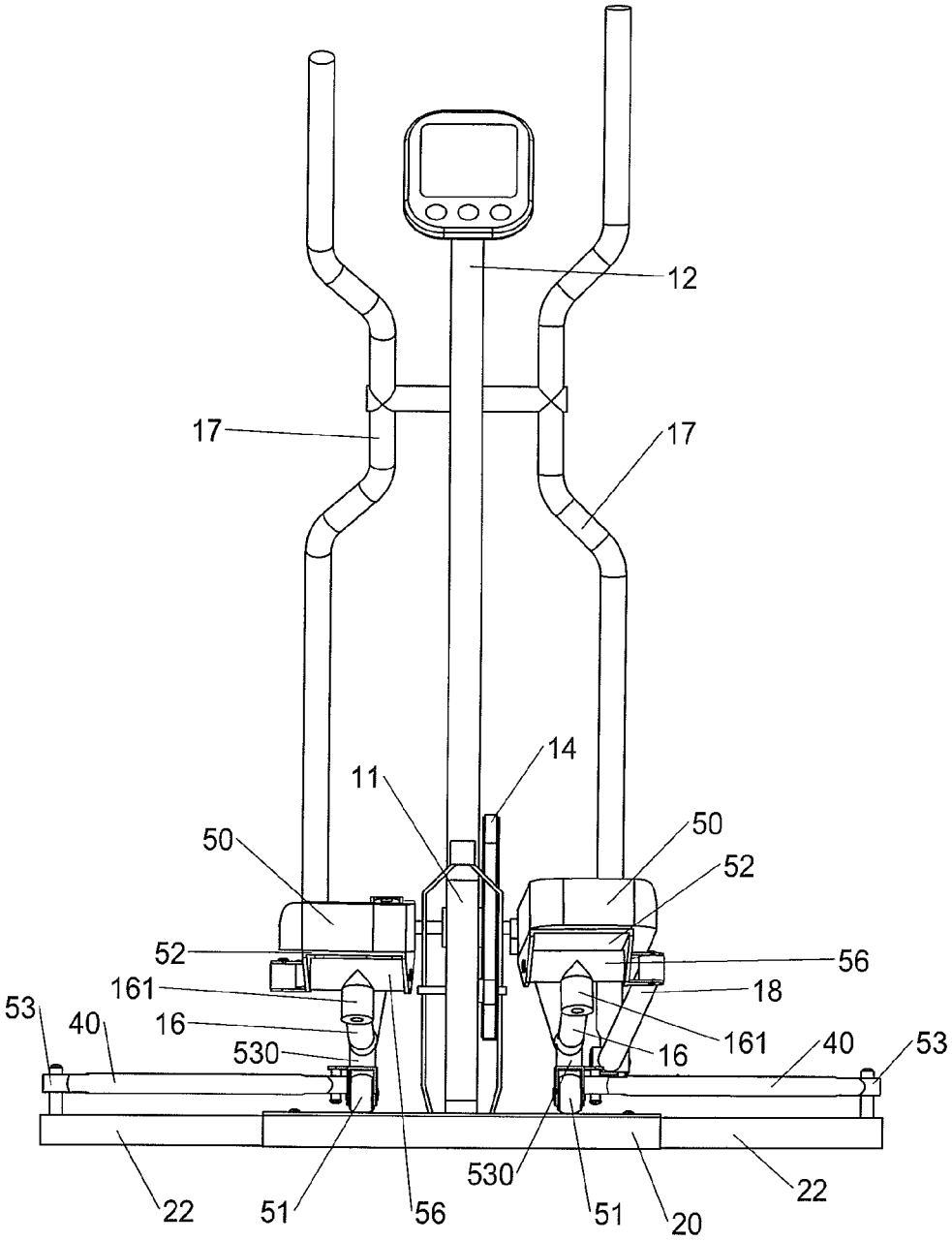
FIG. 7 is a rear operational view of the oblong orbital exercising machine as shown in FIG. 1.
Figure 8:
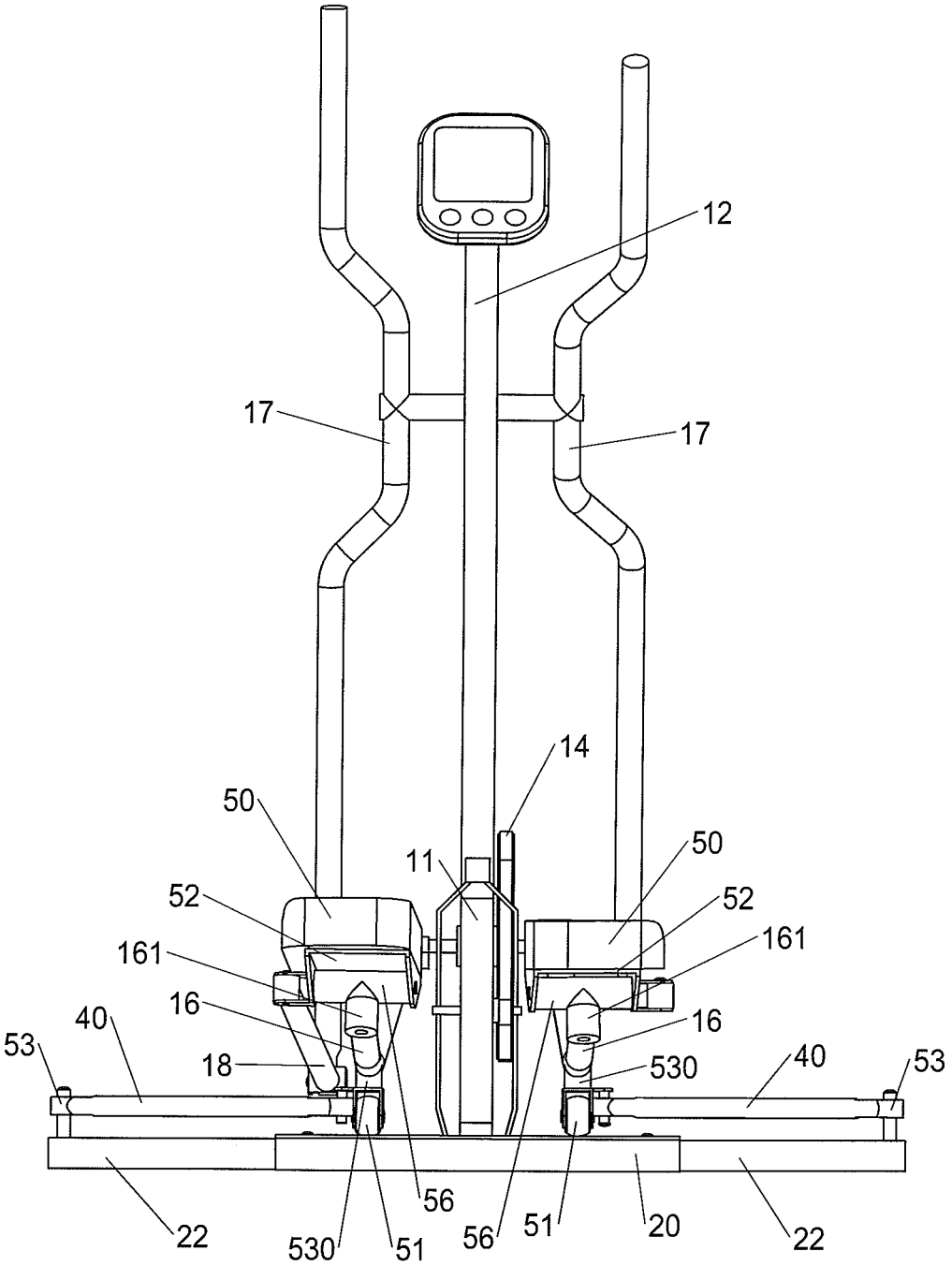
FIG. 8 is another rear operational view of the oblong orbital exercising machine as shown in FIG. 1.
Figure 9:
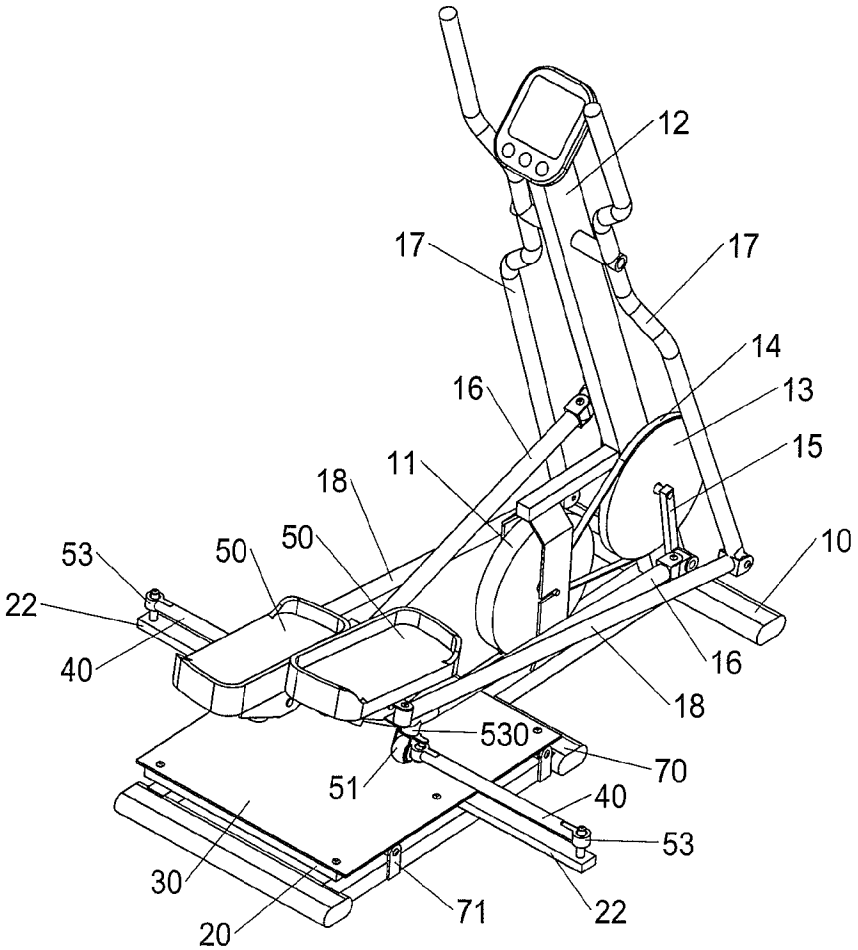
FIG. 9 is a perspective view of an oblong orbital exercising machine in accordance with another preferred embodiment of the present invention.
Figure 10:
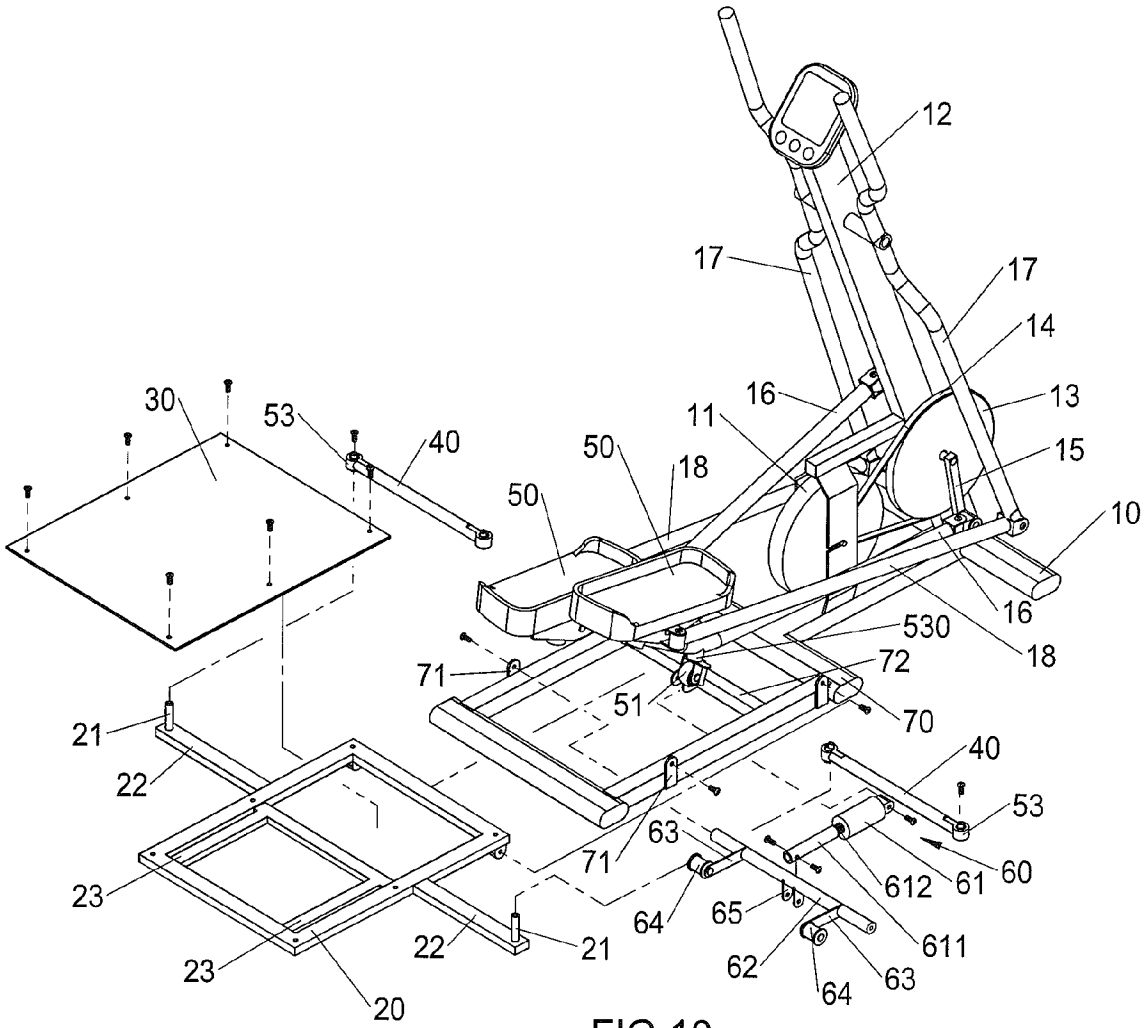
FIG. 10 is a partially exploded perspective view of the oblong orbital exercising machine as shown in FIG. 9.
Figure 11:
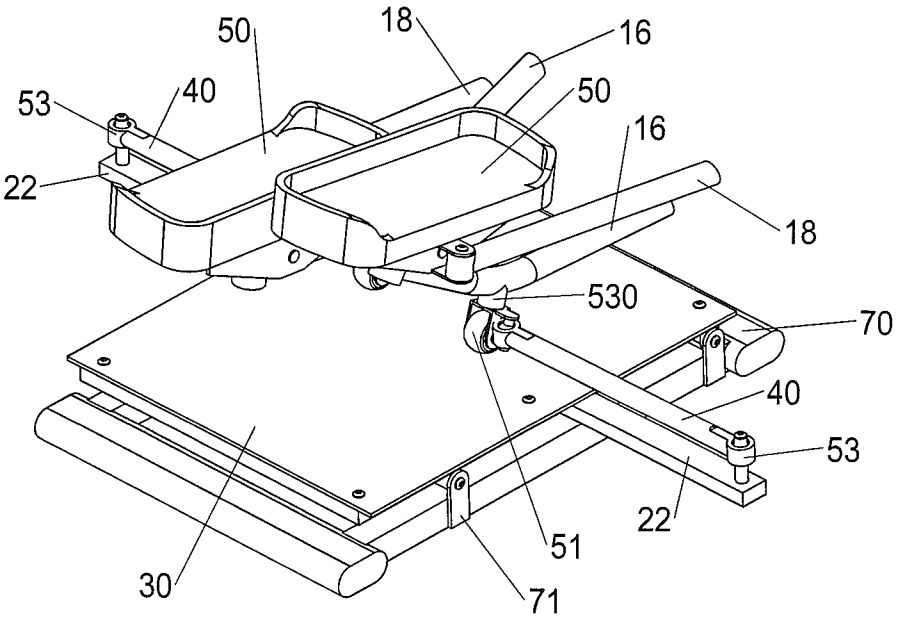
FIG. 11 is a partially perspective view of the oblong orbital exercising machine as shown in FIG. 9.
Figure 12:
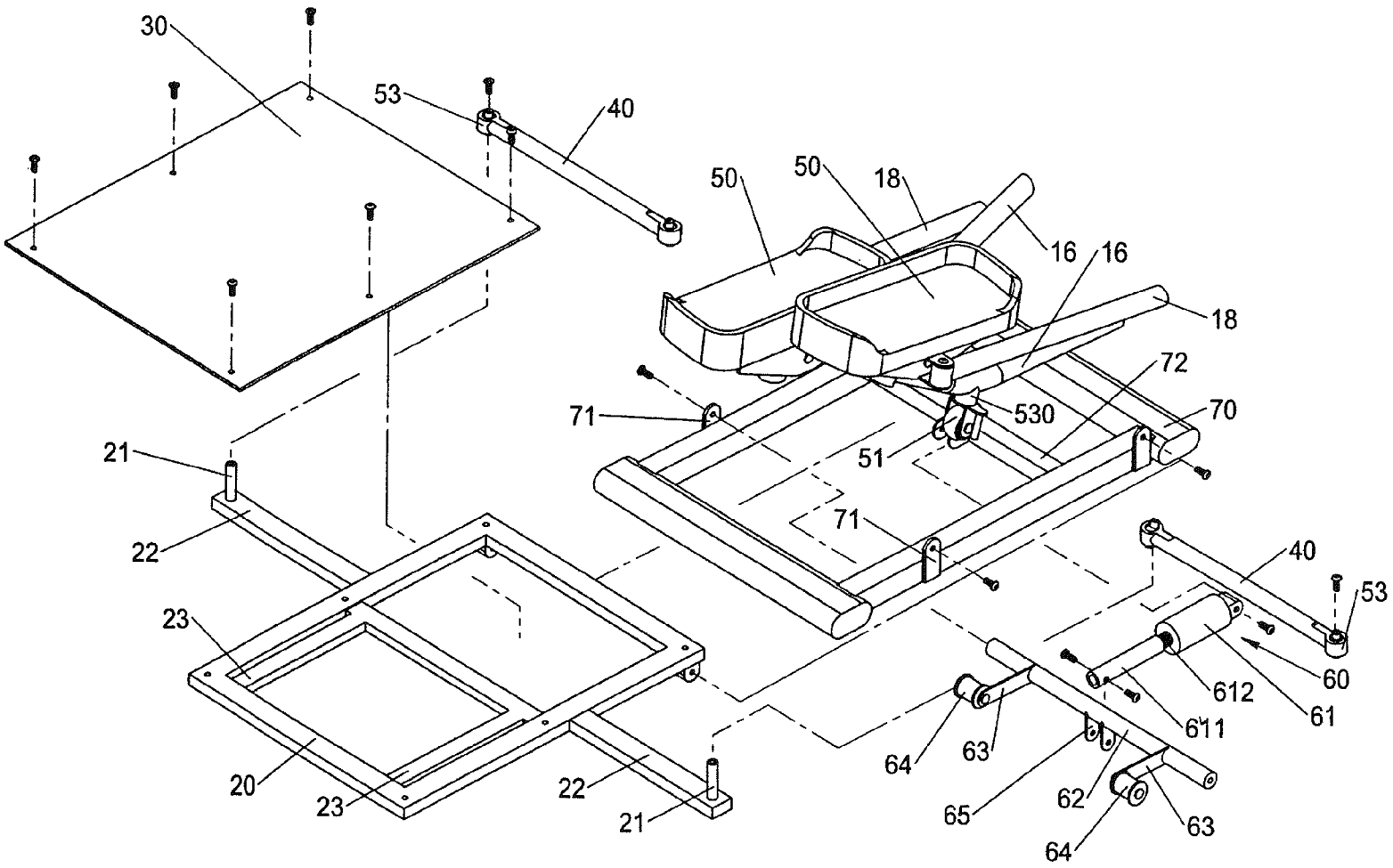
FIG. 12 is an exploded perspective view of the oblong orbital exercising machine as shown in FIG. 11.
Figure 13:
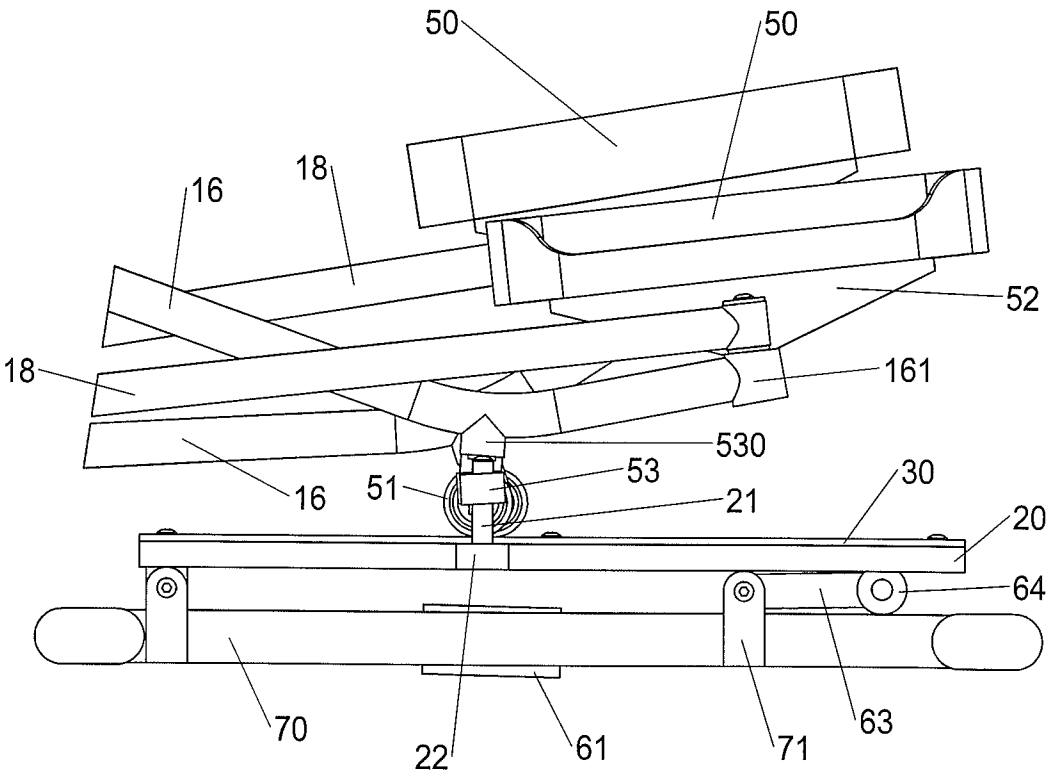
FIG. 13 is a side view of the oblong orbital exercising machine as shown in FIG. 11.

In operation, referring to FIGS. 5-8 with reference to FIGS. 1-4, when a user wishes to use the exercising machine, he/she can stand on the exercising machine, with his/her hands holding the handles 17, and with his/her feet treading the pedals 50. In such a manner, when the cycle movement mechanism 11 is started, the belt wheel 13 is driven via the belt 14 to drive the cranks 15 which drive the driving levers 16 which drive the pedals 50 which drive the driven levers 18 which drive the handles 17, so that the user's hands are driven by the handles 17 to move forward and backward in a reciprocal manner, and the user's feet are driven by the pedals 50 to move forward and backward in a reciprocal manner as to perform an oblong orbit movement. At the same time, each of the swinging members 40 is driven by the respective driving lever 16 and is pivoted about the respective shaft 21 of the base frame 20, so that each of the pedals 50 is driven by the respective driving lever 16 to move forward and backward along an arcuate path by pivoting motion of the respective swinging member 40 as shown in FIGS. 5 and 6. At this time, the primary rollers 51 are moved on the support plate 30 along the arcuate path to facilitate movement of the pedals 50. Thus, each of the pedals 50 is moved forward and backward in an outward curved manner to turn and swing the user's body, thereby enhancing the exercising effect.

Referring to FIGS. 9-16, the oblong orbital exercising machine further comprises a bottom frame 70 located under and pivotally connected with the base frame 20, and a lifting device 60 mounted between the base frame 20 and the bottom frame 70. The base frame 20 has a bottom provided with two guiding tracks 23. The guiding tracks 23 of the base frame 20 are parallel with each other. The bottom frame 70 has a front end pivotally connected with a front end of the base frame 20. The bottom frame 70 is provided with a transverse bar 72 and two support ears 71.

The lifting device 60 is operated to change an inclined angle of the base frame 20 relative to the bottom frame 70. The lifting device 60 includes a rotation bar 62 pivotally mounted between the support ears 71 of the bottom frame 70, a mounting bracket 65 secured on the rotation bar 62, two support members 63 secured on the rotation bar 62, two secondary rollers 64 each rotatably mounted on the respective support member 63 and each slidable on the respective guiding track 23 of the base frame 20, a motor 60 mounted on the transverse bar 72 of the bottom frame 70, a threaded rod 612 mounted on the motor 60, and a mounting sleeve 611 mounted on the threaded rod 612 and pivotally connected with the mounting bracket 65. Each of the secondary rollers 64 of the lifting device 60 abuts the base frame 20. The threaded rod 612 of the lifting device 60 is rotatably mounted in and driven by the motor 60. Preferably, the mounting sleeve 611 of the lifting device 60 is a threaded tube screwed onto the threaded rod 612. Thus, when the threaded rod 612 is rotated by the motor 60, the mounting sleeve 611 is translated linearly relative to the threaded rod 612 and the motor 60 to drive the mounting bracket 65 which drives and rotates the rotation bar 62.

Figure 14:
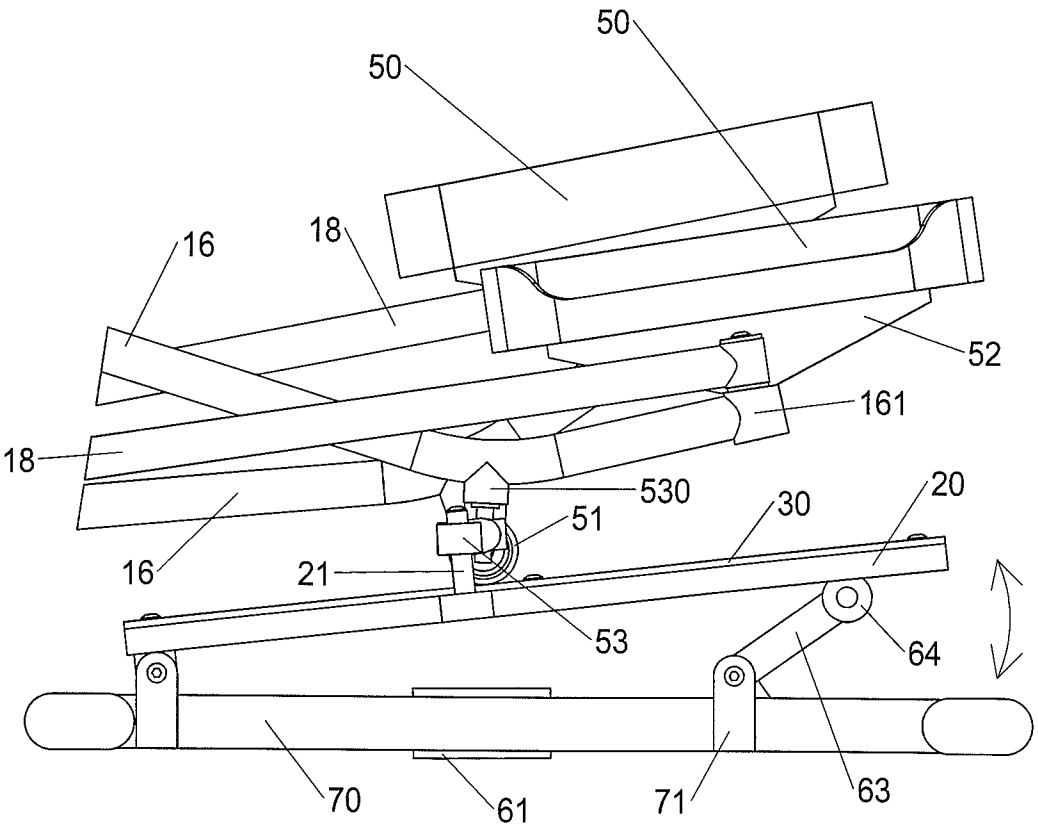
FIG. 14 is a schematic operational view of the oblong orbital exercising machine as shown in FIG. 13.
Figure 15:
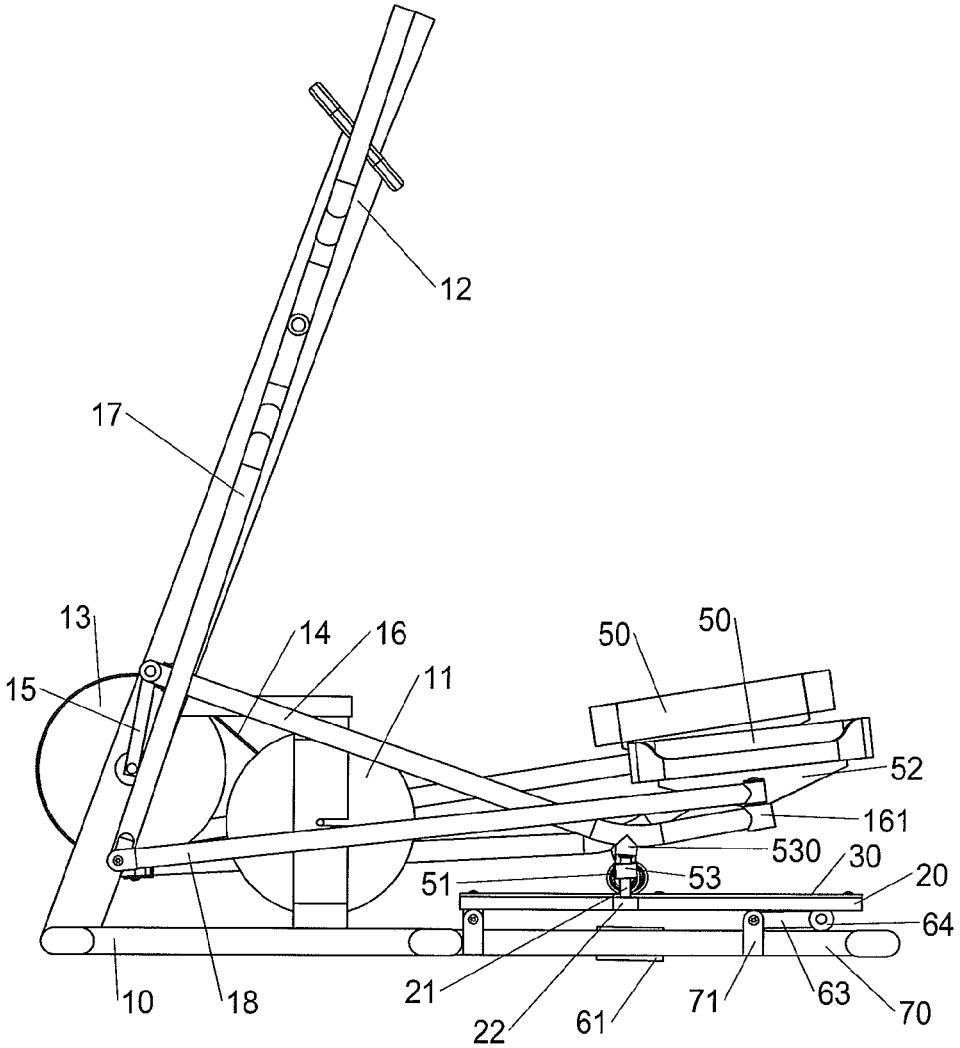
FIG. 15 is a side view of the oblong orbital exercising machine as shown in FIG. 9.
Figure 16:
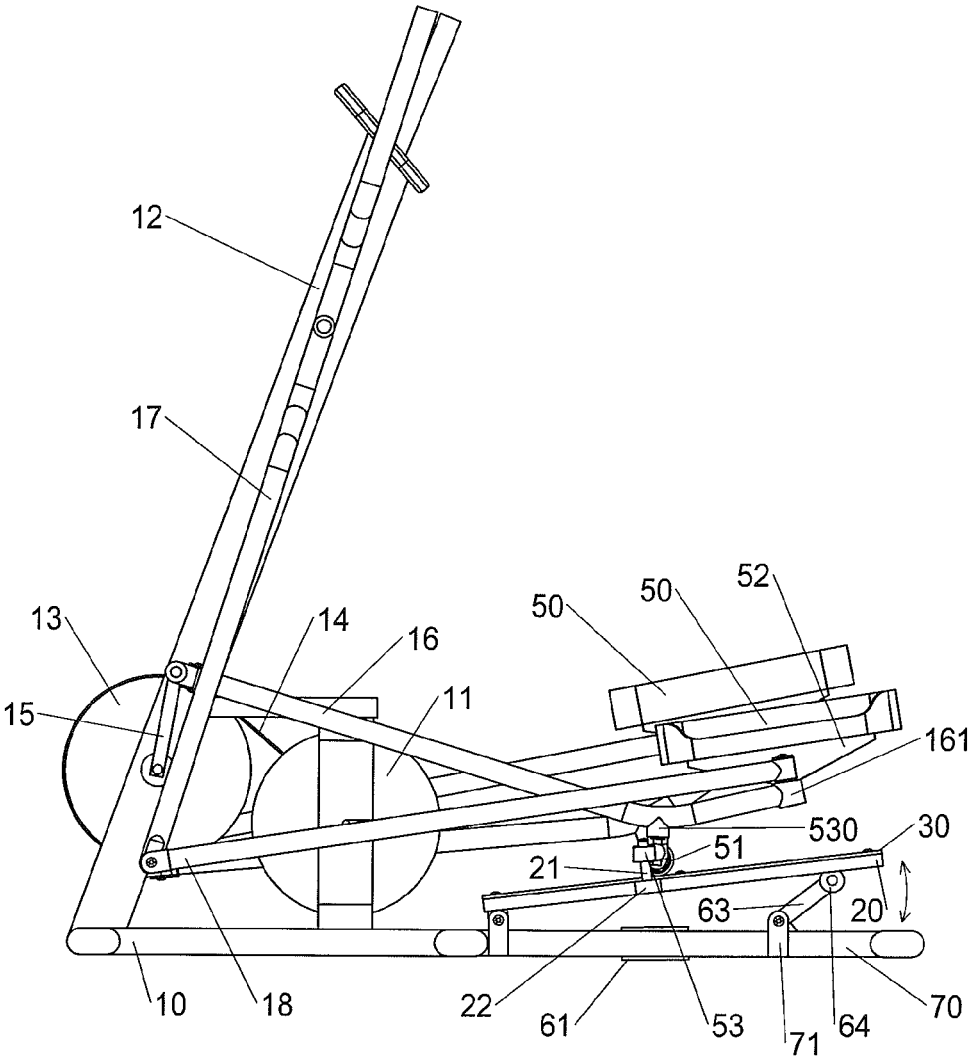
FIG. 16 is a schematic operational view of the oblong orbital exercising machine as shown in FIG. 15.

In operation, referring to FIGS. 13-16 with reference to FIGS. 9-12, when the mounting sleeve 611 is driven by operation of the motor 60 to translate linearly relative to the threaded rod 612, the mounting bracket 65 is pushed by the mounting sleeve 611 so that the rotation bar 62 is rotated by the mounting bracket 65. When the rotation bar 62 is rotated, the support members 63 are pivoted upward with the rotation bar 62 to lift the secondary rollers 64 which push the base frame 20 upward, so that the base frame 20 is pivoted upward relative to the bottom frame 70 so as to change the inclined angle of the base frame 20 relative to the bottom frame 70 as shown in FIGS. 14 and 16. At this time, each of the secondary rollers 64 is moved on and guided by the respective guiding track 23 of the base frame 20, to facilitate pivoting motion of the base frame 20.

Accordingly, the pedals 50 are moved forward and backward in a curved manner to turn and swing the user's body, so as to achieve a full body turning and swinging function, thereby greatly enhancing the exercising effect. In addition, the lifting device 60 is operated to change the inclined angle of the base frame 20 relative to the bottom frame 70, so as to satisfy the user's requirement. Further, the support plate 30 is made easily to replace a conventional sliding track that needs a precise manufacturing process, thereby decreasing the cost and time of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An oblong orbital exercising machine comprising:

a main frame;

an upright mounted on a front portion of the main frame;

a base frame mounted on a rear portion of the main frame and provided with two shafts;

a support plate mounted on the base frame;

two swinging members each having a first end pivotally connected with a respective shaft of the base frame;

two primary rollers each connected with a second end of a respective swinging member and each placed on the support plate;

a cycle movement mechanism mounted on the main frame;

a belt wheel rotatably mounted on the upright;

a belt mounted between the belt wheel and the cycle movement mechanism;

two cranks mounted on two opposite sides of the belt wheel;

two driving levers each having a first end pivotally connected with a respective crank and a second end pivotally connected with a respective primary roller;

two pedals each pivotally connected with the second end of a respective driving lever;

two handles each pivotally mounted on the upright; and two driven levers each having a first end pivotally connected with a respective handle and a second end pivotally connected with a respective pedal; wherein:

each of the swinging members is pivotable about the respective shaft of the base frame; and each of the primary rollers is slidable forward or backward on the support plate along an arcuate path.

2. The oblong orbital exercising machine of claim 1, wherein:

the first end of each of the swinging members is connected with the respective shaft of the base frame by a universal bearing;

each of the primary rollers is located under the respective driving lever and is connected with the second end of the respective driving lever by a universal bearing; and each of the driving levers has a substantially V-shaped profile.

3. The oblong orbital exercising machine of claim 1, wherein:

the base frame is provided with two opposite fixing members;

each of the fixing members is extended outwardly and horizontally from the base frame; and each of the shafts of the base frame is mounted on and perpendicular to a respective fixing member.

4. The oblong orbital exercising machine of claim 1, wherein:

the second end of each of the driving levers is provided with a pivot tube;

each of the pedals has a bottom provided with a bottom board; and the bottom board of each of the pedals is pivotally connected with a pivot member which is pivotally connected with the pivot tube of the respective driving lever.

5. The oblong orbital exercising machine of claim 1, wherein:

the oblong orbital exercising machine further comprises:

a bottom frame located under and pivotally connected with the base frame; and a lifting device mounted between the base frame and the bottom frame;

the base frame has a bottom provided with two guiding tracks;

the bottom frame is provided with a transverse bar and two support ears;

the lifting device includes:

a rotation bar pivotally mounted between the support ears of the bottom frame;

a mounting bracket secured on the rotation bar;

two support members secured on the rotation bar;

two secondary rollers each rotatably mounted on a respective support member and each slidable on a respective guiding track of the base frame;

a motor mounted on the transverse bar of the bottom frame;

a threaded rod mounted on the motor; and a mounting sleeve mounted on the threaded rod and pivotally connected with the mounting bracket; and each of the secondary rollers of the lifting device abuts the base frame.

* * * * *